United States Patent [19]

Bouchard et al.

[11] Patent Number: 4,998,384

[45] Date of Patent: Mar. 12, 1991

[54] GRINDING WHEEL MOUNTING MEANS

[75] Inventors: William L. Bouchard, Washington, N.H.; Robert E. Cummings, Brantford, Canada; Paul W. Kalinowski, Boylston, Mass.; Charles W. Sudol, Hillsboro, N.H.

[73] Assignee: Norton Company, Worcester, Mass.

[21] Appl. No.: 403,204

[22] Filed: Sep. 1, 1989

[51] Int. Cl.[5] ..... B24B 41/00

[52] U.S. Cl. ..... 51/168; 51/209 R

[58] Field of Search ..... 51/168, 209 R

[56] References Cited

U.S. PATENT DOCUMENTS

| | | | |
|---|---|---|---|
| 1,964,539 | 6/1934 | Shue | 51/209 |
| 2,118,409 | 5/1938 | Loewy | 51/209 |
| 2,246,223 | 6/1941 | Shue | 51/209 |
| 2,282,096 | 5/1942 | Talboys | 51/209 R |
| 2,418,883 | 4/1947 | Homeyer | 51/209 |
| 2,450,230 | 9/1948 | Bush | 51/209 R |
| 2,479,078 | 8/1949 | Milligan et al. | 51/209 |
| 3,069,817 | 12/1962 | Kohn, III | 51/209 |
| 3,576,090 | 4/1971 | Shoemaker | 51/209 |
| 3,716,951 | 2/1973 | Walters | 51/168 |
| 4,507,897 | 4/1985 | Vieu et al. | 51/209 |
| 4,551,902 | 11/1985 | Thibaut | 51/168 |

FOREIGN PATENT DOCUMENTS

| | | | |
|---|---|---|---|
| 1045842 | 12/1958 | Fed. Rep. of Germany . | |
| 1927124 | 12/1970 | Fed. Rep. of Germany | 51/168 |
| 1265760 | 5/1961 | France | 51/209 R |
| 1333021 | 6/1963 | France | 51/168 |
| 2357333 | 3/1978 | France | 51/168 |
| 2521054 | 8/1983 | France | 51/168 |
| 565012 | 8/1975 | Switzerland | 51/168 |

*Primary Examiner*—Roscoe V. Parker

*Attorney, Agent, or Firm*—Arthur A. Loiselle, Jr.

[57] ABSTRACT

A combination of a cup shaped or cylindrically shaped grinding wheel and a mounting means for such a wheel.

8 Claims, 1 Drawing Sheet

GRINDING WHEEL MOUNTING MEANS

TECHNICAL FIELD

This invention relates to an improved chuck means for mounting grinding wheels that are particularly shaped to fit into the chuck that has a complimentary shape to provide for a simplified mounting procedure for attaching grinding wheels to the driving means in a grinding machine and more particularly, for providing an improved drive arrangement for mounting cup shaped grinding wheels in a grinding machine wherein said grinding wheels grind on a surface of the wheel that is in a plane perpendicular to the axis about which the wheel rotates.

BACKGROUND AND INFORMATION DISCLOSURE STATEMENT

The following disclosures are representative of the most relevant prior art known to the applicants at the time of the filing of this application.

U.S. Patents 1,964,539—Shue—June 26, 1934
2,118,409—Loewy—May 24, 1938
2,246,223—Shue—June 17, 1941
2,418,883—Homeyer—Apr. 15, 1947
2,479,078—Milligan et al.—Aug. 16, 1949
3,069,897—Kon III—Dec. 25, 1962
3,576,090—Shoemaker—Apr. 27, 1971
4,507,897—Vieau et al.—Apr. 2, 1985

Foreign Patents

West German Auslegeschrift 1,045,842—Dec. 4, 1958

The patents to Loewy, Homeyer, and Kohn III, show the simplest form of mounting means typically used with the grinding wheels for which this invention has been provided. These wheels are known in the trade as Type 2 cylindrical wheels, Type 6 or Type 11 cup wheels, and are adapted to be mounted in a grinding machine to expose the side of a wheel for grinding operations, which side lies in a plane that is perpendicular to the axis about which the wheel rotates.

In all of the just named patents, threaded means are embedded in the back of the wheel to be molded integral with the back side of the wheel structure and a driving means is bolted onto the back side of the wheel to transmit the driving force to the grinding wheel. Loewy shows embedded nutlike members 2 spaced about the central driving opening 3. In this arrangement the nuts must be precisely positioned in the wheel in relation to the shaped central opening 3 that is designed to be fitted over a correspondingly shaped driving protuberance 9 that is integral with a backing plate 6. Homeyer similarly shows a plurality of embedded anchoring means 8 spaced around the back surface of the wheel for receiving bolts 13 to mount the wheel on the driving plate 7. Kohn III describes the use of a backing plate 15 for supporting a number of members 18 integral therewith that are embedded in the body of the wheel. The backing plate assembly may be either molded integral with an organically bonded wheel or can be subsequently assembled together with and cemented to a ceramic wheel, in both cases, the threaded members 18 being embedded within and molded integral with the body of the wheel.

In making such wheels adapted to cooperate with backing plates that are designed to be subsequently mounted on the drive means of the grinding machine, it is apparent that a precision manufacturing process must be followed. Loewy, in the second paragraph of his specification, speaks of some of the problems that are involved. It is his belief that a backing plate is essential for use on cup wheels not only for driving the wheel but also for adding strength. The question of balance in the final wheel structure must be considered in the use of such backing plates. Homeyer provides a procedure for overcoming the problem of warpage in the making of grinding wheels, particularly in the ceramic type of wheel. The back side of his wheel must be trued to a precise shape to fit a backing plate that is used with the anchoring means built into the wheel. The use of the Kohn III invention, necessitates the provision in effect, of a built-in precision backing plate as a fixture to hold his anchoring means in place as the wheel is being fabricated.

Other mounting arrangements are shown in the two Shue patents, Shoemaker, and the Auslegeschrift disclosure. This group teaches the embedding of anchoring means in a cured layer bonded integral with the back surface of the wheel. The two Shue patents provide an abrasive layer bonded to a reinforcing layer that is designed to absorb the centrifugal forces that are developed in the rapidly rotating grinding wheel. The anchoring means of both the Shue patents are engaged behind a wire mesh that is bonded within the reinforcing layer. Shoemaker is generally similar to the Shue structures. The German teaching provides an elaborate injection molding arrangement for assembling the anchoring means 4 in the reinforcing layer 3 bonded to the abrasive wheel 2.

The Shue patents, Shoemaker, and the German disclosure, all make use of special embedded anchoring means that must be precisely positioned to cooperate with bolting means for mounting their grinding wheels on a face plate adapted to be connected in one way or another to the drive spindle of the grinding machine.

The patents to Milligan et al. and Vieau et al. both provided driving plates for cup wheels or the like, mounted integral with the back sides of the wheels. Milligan et al. provide an elaborate layered construction wherein a plurality of ring members, each having a different coefficient of thermal expansion are assembled one on top of the other, whereby to minimize the effect of the difference of the coefficient of thermal expansion of the grinding ring section A as compared with that of the mounting plate section B. By assembling the stack of rings $R^1$ through $R^4$, for example, the respective forces of thermal expansion generated in the abrasive annulus A and the back B are distributed throughout the stack so that no undue stresses are imposed on the grinding wheel body by the heating up of the grinding wheel during the grinding process.

The Vieau et al. patent shows a much less complicated grinding wheel assembly wherein a backing plate is assembled integrally with the grinding wheel, the backing plate being designed to cooperate with a backing plate holder that supports the backing plate on the end of the drive shaft of the grinding machine. The combination of the backing plate and the backing plate holder are adapted to be mounted on the tapered end of the drive shaft to provide a solid and rigid drive connection between the drive shaft and the grinding wheel. In the Vieau et al. construction, all of the grinding force of the machine is transmitted to the grinding wheel through the bond resulting from cementing the backing plate onto the wheel upon curing the wheel with the backing plate in situ.

BRIEF DESCRIPTION OF THE INVENTION

It is the purpose of this invention to provide a relatively simple cup type grinding wheel structure that has no embedded mounting means within its body structure nor is its end opposite from its grinding end integrally bonded to a reinforcing or driving plate. The essence of the invention described herein involves the use of a mounting chuck adapted to be driven by the driving shaft of a grinding machine, the chuck having jaw means for engaging the grinding wheel around its periphery. The combination of the chuck and the mounted wheel held by the chuck may then be driven in the conventional manner to effect the desired grinding operation in which the grinding surface of the wheel rotates in a plane disposed at a right angle with respect to the axis about which the wheel rotates.

The chuck means may be made in a number of configurations and includes a plate for supporting and driving the jaw or other wheel engaging means, the plate being adapted to be mounted in a manner to be rotatably driven by the grinding machine motor. The selected one of the various wheel engaging means shown herein extends beyond the front plane of the plate to be engaged around the periphery of the grinding wheel at the end of the wheel opposite from the grinding face and the wheel engaging means is adapted to be tightened about the wheel to provide a frictional driving contact for rotating the wheel in the performance of its grinding function.

The periphery of the wheel at the end that is engaged by the chuck means is configured in any one of a number of different patterns but preferably is provided with a tapered shape that cooperates with tapered wheel engaging means that tend to draw the end surface of the wheel tightly against the driving plate of the chuck when the jaw means of the chuck are tightened. It is also proposed that the wheel be provided with a major portion of an abrasive composition for completing the grinding activity and minor layer at the end opposite the grinding face that is formulated of less abrasive materials but which is bonded to the grinding portion as the abrasive portion is being cured, which minor layer serves to provide a contact surface for the jaw means.

In addition to the driving frictional engagement the jaw means and the end of the wheel, the contacting surfaces between the chuck means and the wheel may include inter-engaging recesses and bosses to provide for the transmission of the driving forces from the chuck means to the engaged wheel. Also it is to be noted that in some forms of this invention the jaws of the chuck means may be tightened about the periphery of a wheel being rotated at relatively high speeds, to in part at least, provide a force that tends to counteract somewhat the centrifugal forces built up in a rapidly rotating wheel.

The concept of this invention may be applied equally well to a grinding wheel of any composition. Thus a ceramic grinding wheel having a metallic bond could benefit from making use of the features of the chuck and grinding wheel combination disclosed herein.

IN THE DRAWINGS

DESCRIPTION OF THE PREFERRED EMBODIMENTS

Figure 1:
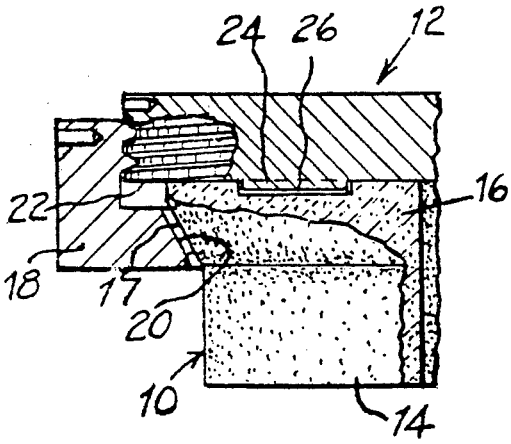
FIG. 1 is a vertical sectional view, partly broken away, that shows a chuck means having a threaded collar for engaging and mounting a grinding wheel on a driving means for a grinding machine.

A typical example of a preferred form of this invention is shown in FIG. 1. The cylindrical cup shaped grinding wheel 10 shown there is supported in a chuck means that includes a drive disk 12 that is mounted on the driving spindle of a grinding machine. This chuck and grinding wheel combination is driven to rotate about a vertical axis, as shown in FIG. 1, and in this example, the grinding wheel has a grinding surface 14 that is forced into contact with the work being ground.

The wheel 10 may be made in any conventional manner of standard formulations where abrasive particles are bound in a matrix of organic polymer or ceramic bond and may be molded directly to shape or trued in the known manner. Preferably, the wheel has an integral layer 16 disposed at its end opposite from the working face 14. The end 16 has a conical outer periphery 17 as shown, that is designed to be engaged by a collar 18 that is made with a corresponding conical seat 20. The collar 18 is threaded internally and is engaged on the threaded periphery of the drive disk 12 whereby to bind the upper end of the wheel tightly against the bottom 22 of the disk means.

Figure 2:
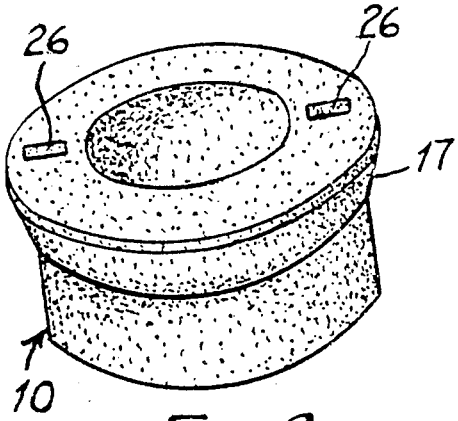
FIG. 2 is a perspective view of a modified Type 2 grinding wheel that exemplifies one of the forms of cup shaped grinding wheels that are well adapted to be mounted in the chuck of this invention.

If desired, the face of the disk that engages the end of the grinding wheel may be provided with bosses 24 that are positioned to fit into corresponding recesses 26 in the end of the wheel as shown in FIG. 2. In any event the collar 18 may be tightened on its threaded support to drive the seat 20 against the periphery of the conical layer 16 whereby to drive the end of the grinding wheel into a tight engagement against its seat 22 on the driving disk 12 and it is thus apparent that a solid frictional driving contact can be established between the chuck and the wheel 10. Another valuable feature of this construction resides in the fact, that as the conical face 20 is driven upwardly against the conical seat 17 on the periphery of layer 16 as shown in FIG. 1, a compressive force is generated within the upper end of the wheel which tends to counteract some of the centrifugal force that builds up in a rapidly rotating wheel.

The integral layer 16 at the end of the wheel may be formed of the same mix as the wheel body itself, but preferably the layer is formulated with a filler having a less abrasive property such as kyanite, glass nodules, metallic filings, mica, etc. The layer 16 is preferably bonded with the same bond composition used in the wheel mix and is matured simultaneously with the wheel as it is being fired or cured. The layer 16 is thus made integral with the abrasive body portion of the wheel and is at least as thick as the depth of the collar 18 below the face 22 of the driving disk 12 to provide a solid seat 17 for interacting with seat 20 of the collar 18 whereby to drive the upper end of the wheel into a driving engagement against the face 22.

Figure 3:
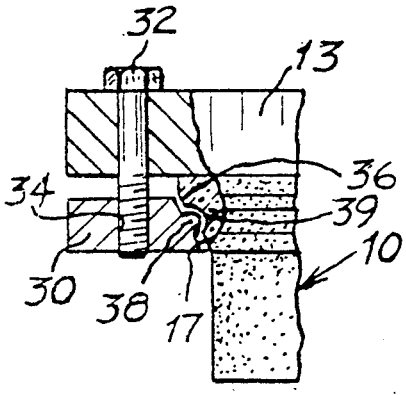
FIG. 3 is a view similar to FIG. 1 that shows an alternate form of this collar for engaging a wheel in the chuck means of this invention.

A modification of the combination chuck and wheel mounting means of FIG. 1 is shown in FIG. 3. In this construction the collar 30 is adapted to be bolted to the driving disk 13 by a plurality of bolts 32 spaced around the periphery of the disk 13 and engaged in the threaded apertures 34 in collar 30. The conical seat 36 of this collar is contoured to have an annular ring 38 formed integral therewith, the ring being positioned to cooperate with a correspondingly shaped annular seat 39 formed in the conical seat 17 of this grinding wheel. This ring and interfitting groove construction provides for additional frictional contact between the collar 30 and the wheel. The annular ring 38 shown in FIG. 3 is semicircular in crossection and is sized to cooperate with the semicircular groove 39 in the conical end of the wheel. The annular ring and the cooperating groove or seat into which it is driven by the tightening of the bolts 32 can have various crossectional shapes that are adapted to increase the frictional contact between these surfaces when the collar is tightened against the wheel. It is suggested that cooperating pairs of rings 38 and grooves or seats 39 that are triangular, i.e. wedge shaped, or square in crossection, can be used for this purpose.

Figure 4:
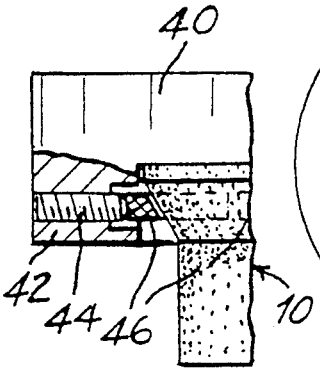
FIG. 4 is a view similar to the view in FIG. 1 showing still form of wheel engaging means for the chuck means.
Figure 5:
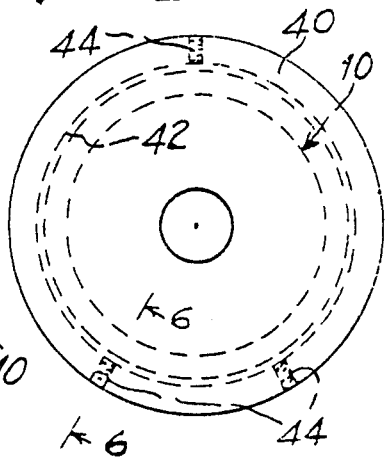
FIG. 5 is a plan view of the form of the wheel engaging chuck means shown in FIG. 4.

In the preferred form, the seating of the wheel on the driving plate 12 has been produced by engaging the conical seat of a circular collar against the conical portion of the upper end of the wheel. In some instances it may be desirable to provide a mounting means as shown in FIGS. 4 and 5 wherein the driving disk 40 has a downwardly extending shoulder 42 that surrounds the end of the grinding wheel 10. At a plurality of spaced positions around the periphery of disk 40 there are set screw means 44 adapted to be driven into contact with the outer peripheral surface of a circular split steel spring 46. The spring is preferably fixed to the driving disk 40 by having one of its ends welded to the disk 40. The spring is provided with a conical inner periphery to compliment the conical surface on the end of the grinding wheel. The peripherally spaced apart set screws 44 can be driven inwardly to engage the spring tightly around the grinding wheel beginning with a screw positioned at a point spaced somewhat away from the welded end, and then progressing serially onwardly toward the free end, to drive the inner surface of the spring throughout its entire length into engagement with the grinding wheel, to transmit the driving force from the disk 40 to the wheel 10.

Figure 6:
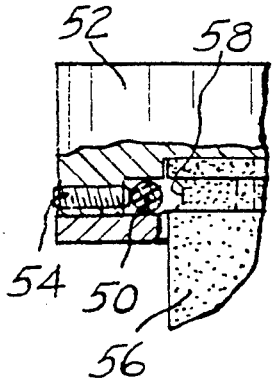
FIG. 6 is a section taken on line 6—6 of FIG. 5 showing still another variation of this type of mounting means like that shown in FIG. 4.

A generally similar spring mounting arrangement is shown in FIG. 6. The construction there shown makes use of a spring 50 having a circular crossection that is mounted in the driving disk 52. The set screws 54 are similarly spaced around the periphery of the driving disk 52 and serially driven inwardly to engage the spring with the wheel. In this form of the invention the wheel 56 is shown as having an outer wall that is cylindrical throughout its entire length. At its upper end the wheel is provided with a semicircular seating groove 58 that is adapted to receive the spring 50 to complete the driving engagement of the chuck means with the grinding wheel. The proportions of the spring and the groove are precisely controlled so that when the spring is driven into the groove the upper end of the wheel is tightly engaged against the bottom surface of the driving disk 52.

With both of the spring type of chuck engaging means shown in FIGS. 4 and 6, an assembly is provided wherein the wheel can be simply held in position inside the spring means and the chuck assembly is centered on the wheel. While the two part chuck plate and collar assemblies shown in FIGS. 1 and 3 are relatively easy to manipulate, the, so to speak, one part chuck plate shown in FIGS. 4, 5, and 6, may provide for an easier device to be used for mounting a wheel in the chuck means.

Figure 7:
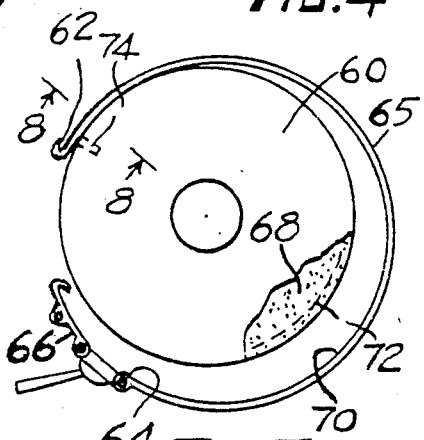
FIG. 7 is a plan view of a chuck plate showing another wheel engaging means.
Figure 8:
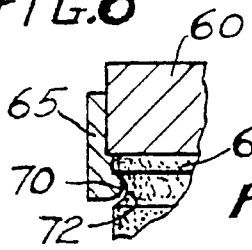
FIG. 8 is a sectional view taken on line 8—8 of FIG. 7.

Another form of a grinding wheel mounting device is shown in FIGS. 7 and 8. The coupling means shown here for mounting the grinding wheel on the driving disk 60, makes use of a toggle coupling means for drawing the two ends 62 and 64 of the split ring 65 of the toggle device together. The conventional toggle coupling 66 is connected to the two ends of this ring to draw the ring tightly around the upper end of the wheel 68 as shown in FIG. 8 to force the annular shoulder 70 integral with the toggle ring 65 into tight frictional engagement with the cooperating seat 72 formed at the end of the wheel that is opposite from the grinding end. If deemed necessary, one end of the toggle ring may be attached to the driving disk 60 by bolting the ring to the disk with a bolt 74.

Figure 9:
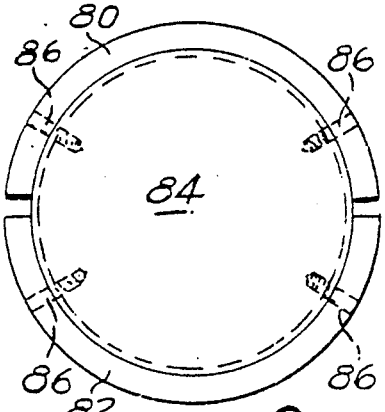
FIG. 9 is a plan showing still another form of wheel engaging means for mounting a cup shaped grinding wheel in a chuck means of this invention.

FIG. 9 shows another form of coupling means for mounting a cup wheel on the chuck means. In this variation a collar composed of two half sections 80 and 82 are fitted to the periphery of the driving disk 84 and are held in place by bolts 86 positioned at the opposite ends of each half section of the collar. Similar to the toggle ring 65 of FIG. 8, each half section 80 and 82 of the collar of FIG. 9 has a portion that extends beyond the driving surface of the disk 84, which extension has an integral shoulder similar to shoulder 70 as shown in FIG. 8 that cooperates with a similar groove 72 as there shown, whereby to frictionally engage the upper end of the grinding wheel against the driving disk 84.

While the description above covers the preferred forms of this invention, it is apparent that modifications thereof may occur to those skilled in the art that will fall within the scope of the following claims.

What is claimed is:

1. The combination of a chuck means for mounting a grinding wheel on a grinding machine which machine is constructed and arranged to drive said wheel to rotate about a longitudinal axis of a driving spindle, and said grinding wheel being adapted to be mounted in said chuck means to be rotated about said axis with a grinding surface of said wheel being disposed at a right angle to said axis comprising a disk adapted to be connected to the spindle of said machine to be rotatably driven, interengaging means for frictionally coupling said grinding wheel to said disk, said interengaging means being adapted to be coupled with said driving disk to rotate therewith, said grinding wheel having a configured bearing end oppositely disposed from said grinding end that is adapted to be frictionally engaged by said interengaging means, said interengaging means carrying a contacting surface for engaging said configured end of said grinding wheel, said contacting surface being complimentarily configured to intimately engage with the configured end of said grinding wheel, the configured end of said grinding wheel is a conical shape, said contacting surface has a complimentary conical shape, and wherein said conical shape of said grinding wheel and said complimentary shaped interengaging means are provided with interfitting ridge and groove means.

2. The combination of a chuck means for mounting a grinding wheel on a grinding machine which machine is constructed and arranged to drive said wheel to rotate about a longitudinal axis of a driving spindle, and said grinding wheel being adapted to be mounted in said chuck means to be rotated about said axis with a grinding surface of said wheel being disposed at a right angle to said axis comprising a disk adapted to be connected to the spindle of said machine to be rotatably driven, interengaging means for frictionally coupling said grinding wheel to said disk, said interengaging means being adapted to be coupled with said driving disk to rotate therewith, said grinding wheel having a configured bearing end oppositely disposed from said grinding end that is adapted to be frictionally engaged by said interengaging means, said interengaging means carrying a contacting surface for engaging said configured end of said grinding wheel, said contacting surface being complimentarily configured to intimately engage with the configured end of said grinding wheel, the configured end of said grinding wheel is a conical shape, said contacting surface has a complimentary conical shape, and wherein said configured conical shape has groove means therein and said contacting surface has complimentary ridge means integral therewith for interfitting with said groove means.

3. The combination of a chuck means for mounting a grinding wheel on a grinding machine which machine is constructed and arranged to drive said wheel to rotate about a longitudinal axis of a driving spindle, and said grinding wheel being adapted to be mounted in said chuck means to be rotated about said axis with a grinding surface of said wheel being disposed at a right angle to said axis comprising a disk adapted to be connected to the spindle of said machine to be rotatably driven, interengaging means for frictionally coupling said grinding wheel to said disk, said interengaging means being adapted to be coupled with said driving disk to rotate therewith, said grinding wheel having a configured bearing end oppositely disposed from said grinding end that is adapted to be frictionally engaged by said interengaging means, said interengaging means carrying a contacting surface for engaging said configured end of said grinding wheel, said contacting surface being complimentarily configured to intimately engage with the configured end of said grinding wheel, the configured end of said grinding wheel is a conical shape, said contacting surface has a complimentary conical shape, and wherein said configured conical shape is surrounded with a groove disposed substantially midway along its length and said contacting surface is surrounded with a complimentary ridge integral therewith for interfitting with said groove.

4. The combination of a chuck means for mounting a grinding wheel on a grinding machine which machine is constructed and arranged to drive said wheel to rotate about a longitudinal axis of a driving spindle, and said grinding wheel being adapted to be mounted in said chuck means to be rotated about said axis with a grinding surface of said wheel being disposed at a right angle to said axis comprising a disk adapted to be connected to the spindle of said machine to be rotatably driven, interengaging means for frictionally coupling said grinding wheel to said disk, said interengaging means being adapted to be coupled with said driving disk to rotate therewith, said grinding wheel having a configured bearing end oppositely disposed from said grinding end that is adapted to be frictionally engaged by said interengaging means, said interengaging means carrying a contacting surface for engaging said configured end of said grinding wheel, said contacting surface being complimentarily configured to intimately engage with the configured end of said grinding wheel, wherein said driving disk has a circular shape, said interengaging means being a split circular spring means arranged concentrically with respect to said disk and being fixedly attached to one end of said disk, said spring means being of a size to surround the end of said grinding wheel opposite from its grinding end, there being a plurality of set screw means supported around the periphery of said disk to engage against spaced points around the spring to drive the spring into frictional contact with the end grinding wheel that is opposite from the grinding end.

5. The combination of claim 4 wherein said end of said wheel opposite from said grinding end has a conical shape and said spring has a complimentary conical integral periphery that is shaped to engage a grinding wheel.

6. The combination of claim 4 wherein said end of said grinding wheel opposite from the grinding end has a groove therein that has a semicircular shape and said spring means has a circular crossection that compliments the dimension of the groove.

7. The combination of claim 4 wherein said end of said grinding wheel opposite from the grinding end has a groove of a defined crossection therein that surrounds said end and said spring having a complimentary defined crossection for interfitting with said groove.

8. The combination of a chuck means for mounting a grinding wheel on a grinding machine which machine is constructed and arranged to drive said wheel to rotate about a longitudinal axis of a driving spindle, and said grinding wheel being adapted to be mounted in said chuck means to be rotated about said axis with a grinding surface of said wheel being disposed at a right angle to said axis comprising a disk adapted to be connected to the spindle of said machine to be rotatably driven, interengaging means for frictionally coupling said grinding wheel to said disk, said interengaging means being adapted to be coupled with said driving disk to rotate therewith, said grinding wheel having a configured bearing end oppositely disposed from said grinding end that is adapted to be frictionally engaged by said interengaging means, said interengaging means carrying a contacting surface for engaging said configured end of said grinding wheel, said contacting surface being complimentarily configured to intimately engage with the configured end of said grinding wheel, wherein said driving disk is a circular element and said interconnecting means includes two half circular elements adapted to be bolted to the periphery of said driving disk means, each of said half circular elements having a skirt portion that extends beyond said disk, and said skirt portions of each half circular element having a skirt portion that extends beyond said disk, and said skirt portions of each half circular element having configured integral engaging means thereon adapted to be frictionally engaged with said configured end of said wheel.

* * * * *